US008596182B2

(12) United States Patent
Mann et al.

(10) Patent No.: US 8,596,182 B2
(45) Date of Patent: Dec. 3, 2013

(54) SPALL LINER

(75) Inventors: Thomas Mann, Littleton, MA (US); Denise Mahnken, Lunenburg, MA (US); Michael E. McCormack, II, Hanson, MA (US); Martin Edward Smirlock, Concord, MA (US); Robert C. Sykes, Burlington, MA (US)

(73) Assignee: Foster-Miller, Inc., Waltham, MA (US)

( * ) Notice: Subject to any disclaimer, the term of this patent is extended or adjusted under 35 U.S.C. 154(b) by 1600 days.

(21) Appl. No.: 11/820,692

(22) Filed: Jun. 20, 2007

(65) Prior Publication Data

US 2012/0174745 A1 Jul. 12, 2012

(51) Int. Cl.
*F41H 5/06* (2006.01)

(52) U.S. Cl.
USPC ..... 89/36.08; 89/36.11; 244/121

(58) Field of Classification Search
USPC ..... 89/36.07, 36.08, 36.11, 36.05; 244/121; 2/2.5
See application file for complete search history.

(56) References Cited

U.S. PATENT DOCUMENTS

| | | | | |
|---|---|---|---|---|
| 4,079,464 | A | 3/1978 | Roggin | |
| 4,310,585 | A * | 1/1982 | Shannon | 428/218 |
| 4,633,756 | A | 1/1987 | Rudoi | |
| 4,664,967 | A | 5/1987 | Tasdemiroglu | |
| 4,928,575 | A | 5/1990 | Smirlock et al. | |
| 5,102,723 | A * | 4/1992 | Pepin | 428/223 |
| 5,169,700 | A * | 12/1992 | Meier et al. | 428/74 |
| 5,170,690 | A | 12/1992 | Smirlock et al. | |
| 5,333,532 | A | 8/1994 | Smirlock et al. | |
| 5,436,075 | A * | 7/1995 | Sawko | 428/375 |
| 5,517,894 | A | 5/1996 | Bohne et al. | |
| 5,663,520 | A | 9/1997 | Ladika et al. | |
| 5,679,918 | A | 10/1997 | Korpi et al. | |
| 5,778,506 | A | 7/1998 | Gonzalez | |
| 5,905,225 | A | 5/1999 | Joynt | |
| 6,298,765 | B1 * | 10/2001 | Dvorak | 89/36.02 |
| 6,327,954 | B1 | 12/2001 | Medlin | |
| 6,568,310 | B2 | 5/2003 | Morgan | |
| 6,612,217 | B1 * | 9/2003 | Shockey et al. | 89/36.11 |
| 7,225,717 | B2 | 6/2007 | Williams | |
| 7,597,040 | B2 * | 10/2009 | Gabrys | 89/36.02 |
| 2003/0192426 | A1 | 10/2003 | Peretz | |
| 2003/0221547 | A1 | 12/2003 | Peretz | |
| 2007/0017359 | A1 | 1/2007 | Gamache et al. | |
| 2007/0113729 | A1 | 5/2007 | Monk et al. | |
| 2009/0140097 | A1 * | 6/2009 | Collier et al. | 244/121 |

FOREIGN PATENT DOCUMENTS

| | | |
|---|---|---|
| DE | 3226476 | 7/1988 |
| DE | 102004060267 | 6/2006 |
| EP | 0334263 | 9/1989 |
| EP | 0578085 | 1/1994 |
| GB | 2390578 | 1/2004 |
| WO | WO 95/10750 | 4/1995 |

* cited by examiner

*Primary Examiner* — Stephen M Johnson
(74) *Attorney, Agent, or Firm* — Iandiorio Teska & Coleman, LLP

(57) ABSTRACT

A spall liner including a first plurality of flexible fabric plies of a first dimension secured together and secured to a first tie layer of a second, larger dimension. At least a second plurality of flexible fabric plies are secured together and secured to a second tie layer. The first and second tie layers are secured together. A cover includes separable fastener structure of a first type for removeably securing the liner to the inside hull of a vehicle equipped with separable fastener structure of a second type.

19 Claims, 7 Drawing Sheets

SPALL LINER

FIELD OF THE INVENTION

This subject invention relates to armor.

BACKGROUND OF THE INVENTION

A spall liner is a type of armor typically attached to the inside hull of a vehicle such as a helicopter, aircraft, watercraft vessel, or ground vehicle. See U.S. Pat. Nos. 5,170,690 and 5,333,532 incorporated herein by this reference. The spall liner may include plies of Kevlar® or other similar ballistic protective material and may be assembled in panels tailored to match the inside configuration of the vehicle (for example, wall, door, floor, and ceiling panels).

As our military faces new weapons and threats, there is a need for very thick spall liners, for example, 37 or more plies of Kevlar® or even as thick as 50 or more plies of Kevlar®. Contrary to conventional wisdom, it has now been demonstrated that very thick spall liners are effective as armor for a number of different threats.

It is very difficult to secure that many plies of Kevlar® together. Modern sewing machines, for example, cannot sew more than about 10-12 or perhaps as many as 19 plies of Kevlar® depending on their thickness. If the numerous plies of Kevlar® in a thick spall liner are not secured together, its durability in the field is diminished. If the plies are too tightly sewed together, the ballistic effectiveness of the spall liner in the field is also diminished.

SUMMARY OF THE INVENTION

It is therefore an object of this invention to provide a spall liner with numerous plies of Kevlar® or similar ballistic protective material and a method of making the same.

It is a further object of this invention to provide such a spall liner which is modular, easy to install, removable, and effective against different types of threats.

It is a further object of this invention to provide such a spall liner which can be tailored depending on the likely threats to be encountered.

The subject invention results from the realization that a thicker spall liner is effected by adding tie layers to each set of plies, by securing the plies to their respective tie layer, and then securing the tie layers together.

The subject invention, however, in other embodiments, need not achieve all these objectives and the claims hereof should not be limited to structures or methods capable of achieving these objectives.

The subject invention features a spall liner comprising a first plurality of flexible fabric plies of a first dimension secured together and secured to a first tie layer of a second, larger dimension. At least a second plurality of flexible fabric plies are secured together and secured to a second tie layer. The first and second tie layers are secured together. There may be a cover and separable fastener structure of a first type on the cover for removeably securing the liner to the inside hull of a vehicle equipped with separable fastener structure of a second type. There may be additional ply sets each secured to a tie layer. In one example with three ply sets and three tie layers, all the flexible fabric plies are of the first dimension, each tie layer is larger than the first dimension. The first tie layer may be the largest and the second tie layer may be slightly smaller than the first tie layer. The third tie layer may be slightly smaller than or the same size as the second tie layer.

In one example, the first plurality of fabric plies are sewn together and to the first tie layer and the second plurality of fabric plies are sewn together and to the second tie layer. The cover may be sewn to the periphery of the first and second tie layers. Preferably, a binder is secured over the cover about the periphery of the first and second tie layers. The binder may be sewn over the cover about the periphery of the first and second tie layers.

In one example, the plies and tie layers are made of Kevlar® or other ballistic protective fabric or material. The cover is typically made of Cordura or other fabric. The separable fastener structure of the first type may include loop fasteners. The separable fastener structure of the first type can be a layer laminated to a side of the cover.

The cover can include an inward layer including the separable fastener structure of the first type on its outside surface and an outward layer extending over the periphery of the tie layers.

The subject invention also features a method of making a spall liner. A first plurality of flexible fabric plies of a first dimension are assembled and secured together and to a first tie layer of a second, larger dimension. A second plurality of flexible fabric plies are assembled and secured together and to a second tie layer. The first and second tie layers are secured together. The first and second fabric plies and the first and second tie layers are then covered and separable fastener structure of a first type (e.g., loop fasteners) is secured to the cover. There may be additional ply sets and tie layers.

The method may further include the step of securing separable fastener structure of a second type (e.g., hook fasteners) to the inside hull of a vehicle and releasably attaching the separable fastener structure of the first type on the cover to the separable fastener structure of the second type.

Securing the first plurality of fabric plies together and to the first tie layer typically includes sewing. Securing the second plurality of fabric plies together and to the second tie layer typically also includes sewing. Covering the first and second fabric plies and the first and second tie layers may include securing a binder over the cover about the periphery of the first and second tie layers. The binder may be sewn over the cover about the periphery of the first and second tie layers. A layer of fasteners can be laminated to the cover before it is assembled over the ply sets and the tie layers.

The subject invention further features an armor kit comprising a number of panels each conforming to a different portion of the inside hull of a vehicle. Each panel comprises a first plurality of flexible fabric plies of a first dimension secured together and secured to a first tie layer of a second, larger dimension. At least a second plurality of flexible fabric are secured together and secured to a second tie layer. The first and second tie layers are secured together. A cover includes separable fastener structure of a first type for removeably securing the liner to the inside hull of a vehicle equipped with separable fastener structure of a second type. Separable fastener structure of a second type is securable to the inside hull of the vehicle.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
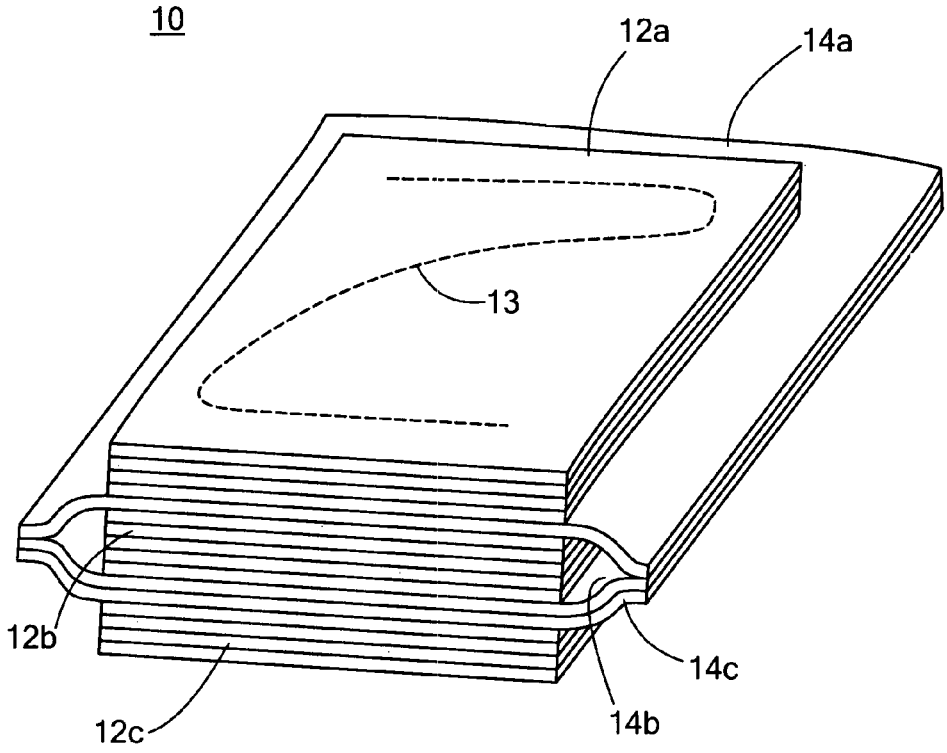
FIG. 1 is a highly schematic three-dimensional partly cross-sectional view of an armor panel or spall liner in accordance with an example of the subject invention before the cover is added.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows an example of a spall liner 10 in the form of a panel without a cover. A first plurality of flexible fabric plies 12*a* of a first dimension are cut to the shape desired and secured together and also secured (typically by sewing as shown at 13) to first flexible tie layer 14*a* of a second, slightly larger dimension. A second plurality of flexible plies 12*b* of the first, smaller dimension are cut to the shape desired and secured to each other and also secured to second flexible tie layer 14*b* of at least the second, larger dimension. Similarly, an optional third plurality of flexible plies 12*c* are secured together and also to third flexible tie layer 14*c*. The layers 14*b* and 14*c* are disposed adjacent each other. Then, the tie layers 14*a*, 14*b*, and 14*c* are secured together also typically by sewing. Each ply set 12*a*-12*c* may include 10-12 individual plies. Tie layer 14*a* may be larger than tie layer 14*b* which itself may be larger than tie layer 14*c* to allow the tie layer edges to line up when assembled to account for the drape distance.

In this way, since conventional sewing equipment cannot readily sew through all the plies of ply sets 12*a*, 12*b*, and 12*c*, all the plies are still secured together via tie layers 14*a*-14*c*. It is also beneficial to locate tie layers adjacent each other to maximum extent possible as shown for tie layers 14*b* and 14*c*.

The individual plies may be sheets of Kevlar® or similar ballistic protective material approximately 0.009 inches-0.029 inches thick. The thickness may vary widely. There may be 10 or more plies in each ply set 12*a*-12*c*. Typically, a tie layer (also Kevlar®) of equivalent thickness or a different thickness as the other individual plies is added between ply sets when the number of plies exceeds 10-11 plies, or whatever number of plies presents a barrier to sewing. In this way, when 30 plies are desired, three tie layers are included as shown in FIG. 1. 60 plies, for example, could be accomplished by including six sets of 10 plies each with a tie layer and then securing all six tie layers together as discussed above. In such a panel, there could be three pairs of adjacent tie layers.

In the example shown in FIG. 1, the resulting panel is 12" square. The plies of each ply set 12*a*-12*c* are cut to each 10" square and the tie layers 14*a*-14*c* are 12" square. The layer 14*a* may be slightly larger in area than tie layer 14*b* and tie layer 14*b* may be the same size as tie layer 14*b* or slightly larger in area than tie layer 14*b* to account for the drape distance. Numerous configurations, however, are possible and each panel is generally tailored to conform to a particular vehicle portion such as a wall, door, floor portion, seat, or the like of the inside hull of a ground vehicle, an aircraft, a watercraft, and the like. The plies and tie layers are thus cut from large sheets of Kevlar® in the pattern desired.

Figure 2:
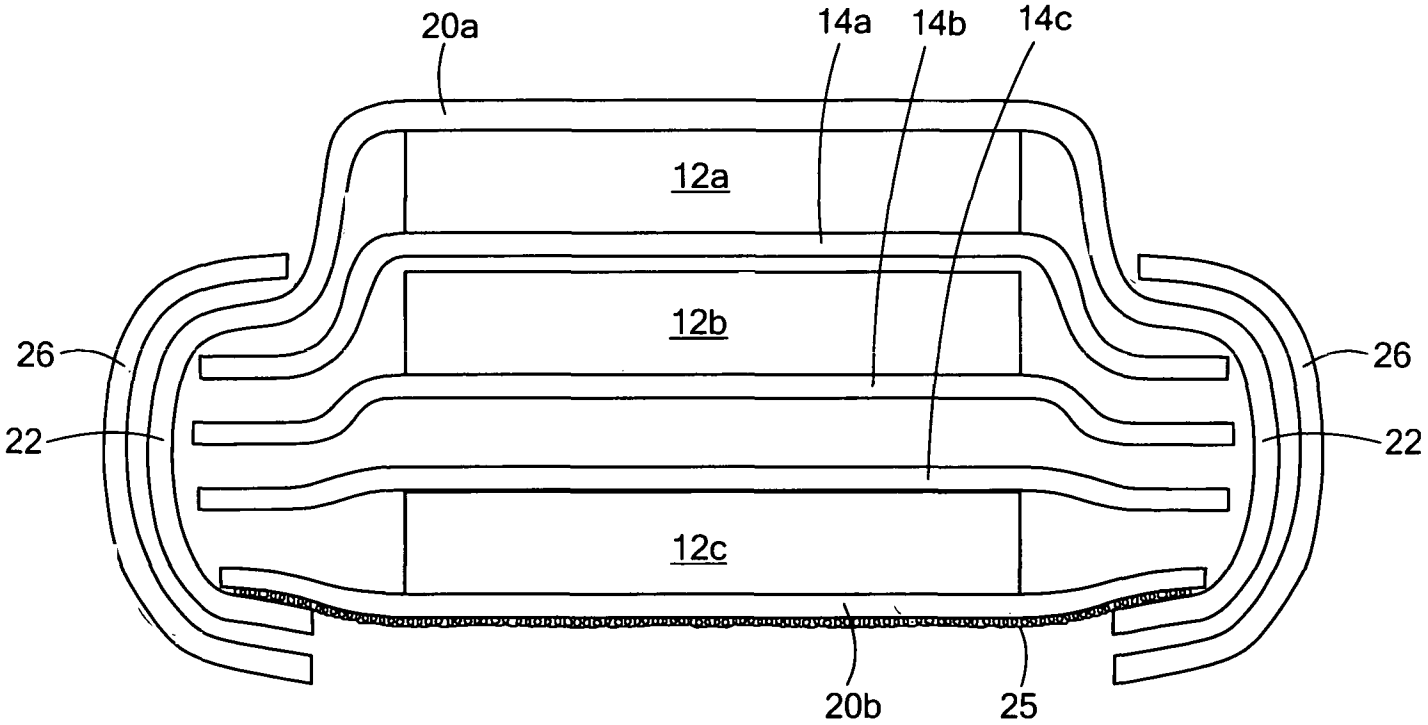
FIG. 2 is a highly schematic cross-sectional partially exploded view showing the spall liner of FIG. 2 with the cover now attached.

FIG. 2 shows outward flexible cover layer 20*a* (typically made of Cordura roughly 0.010 inches thick) extending over the periphery of the tie layers 14*a*, 14*b*, and 14*c* as shown at 22. Inward cover layer 20*b* includes a layer of separable fastener structure of a first type 25 (for example, Velcro® loops) laminated thereto over its whole outer surface. Binder layer 26 (e.g., nylon webbing 1.5" wide) is placed over the cover layer 20*a*, cover layer 20*b*, and the tie layers 14*a*-14*c* as shown around the periphery of the panel and a sewing operation sews binding layer 26, cover layer 20*a*, tie layers 14*a*-14*c*, and cover layer 20*b* all together.

Figure 3:
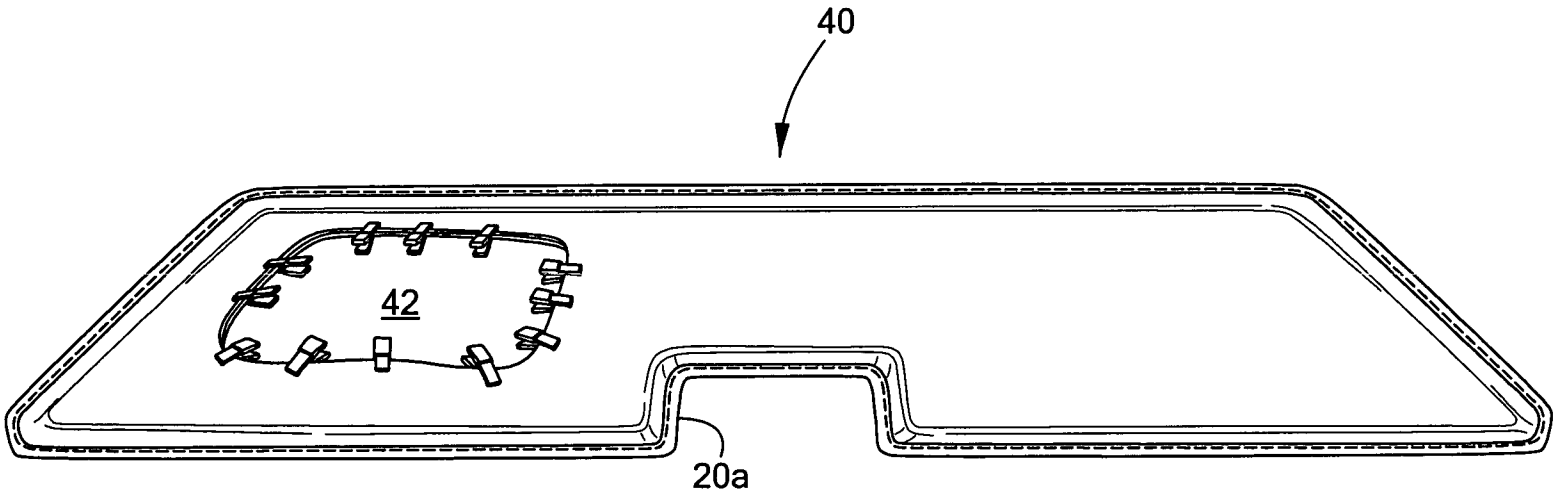
FIG. 3 is a schematic three-dimensional top view showing the assembly of a spall liner in accordance with the subject invention.

FIG. 3 shows a panel 40 being fabricated wherein a portion of the binder about the outer perimeter is complete. Top cover layer 20*a* is folded over the edges of the plies, the tie layers, and the bottom cover layer around the periphery of opening 42 and clamped thereto prior to sewing a binder around the edges of opening 42.

Figure 4:
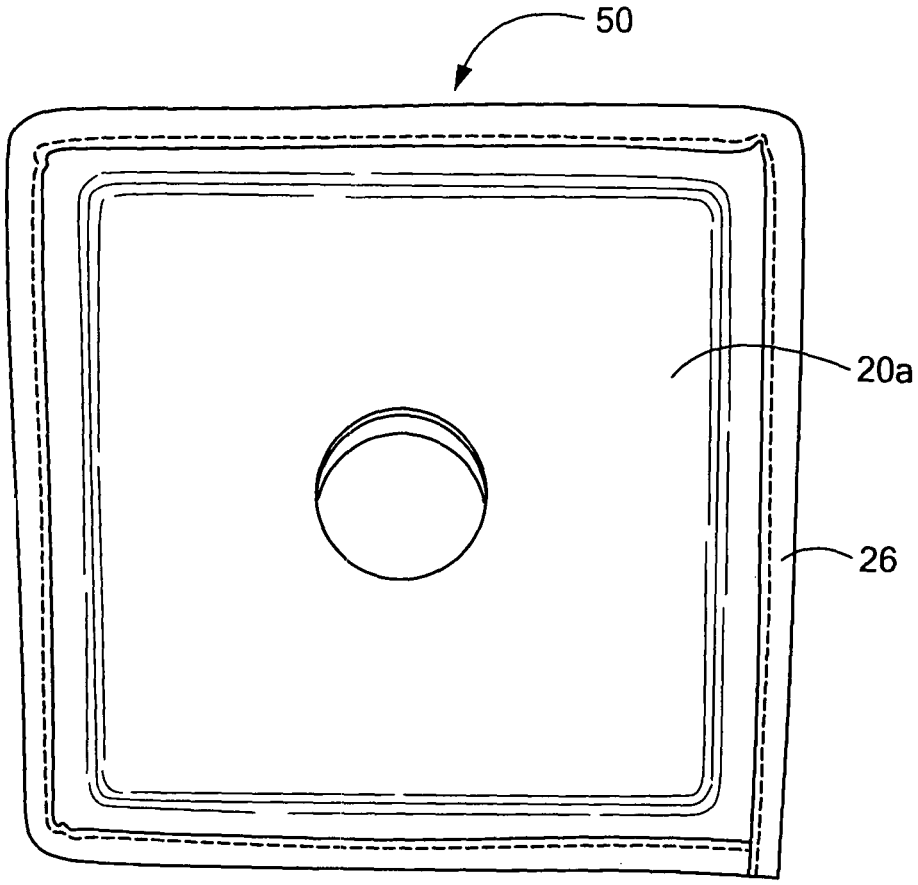
FIG. 4 is a schematic three-dimensional top view of an example of an armor panel in accordance with the subject invention.
Figure 5:
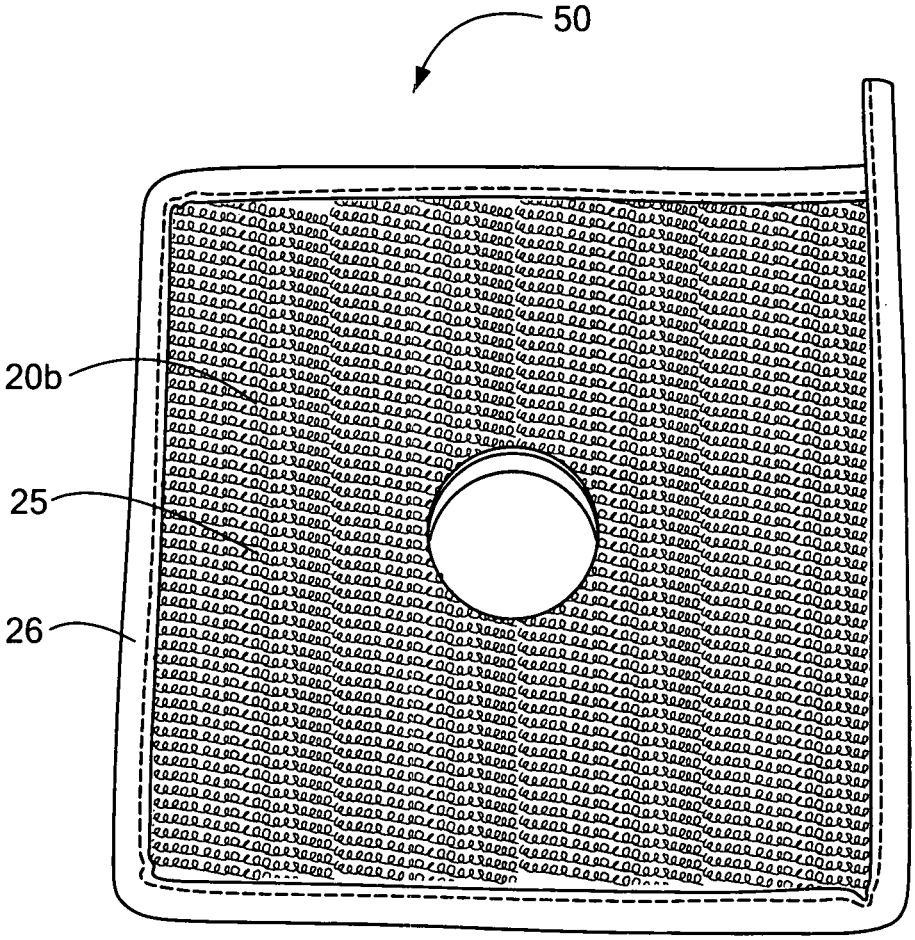
FIG. 5 is a schematic three-dimensional bottom view of the armor panel shown in FIG. 4.

FIG. 4 shows another panel 50 with outward cover layer 20*a* and binder 26. FIG. 5 shows inward cover layer 20*b* with Velcro® loops 25 over its extent.

Figure 6:
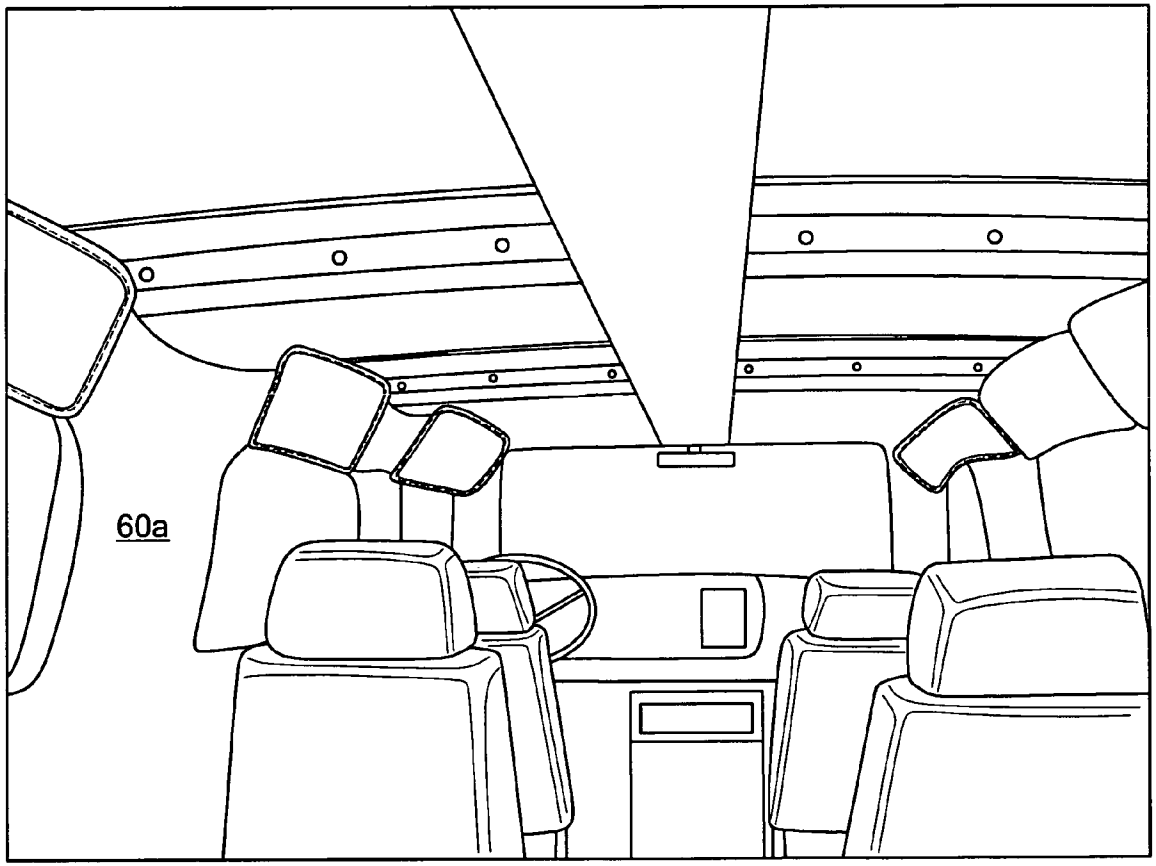
FIG. 6 is a highly schematic three-dimensional view showing the interior of a vehicle with a number of different spall liners releasably secured to the inside of the vehicle.

FIG. 6 shows panels such a panel 60*a* as a kit installed inside a vehicle. The Velcro® loop material on the inside cover layers of each panel are releasably secured to Velcro® hook strips or panels adhered to the inside walls of the vehicle.

Figure 7:
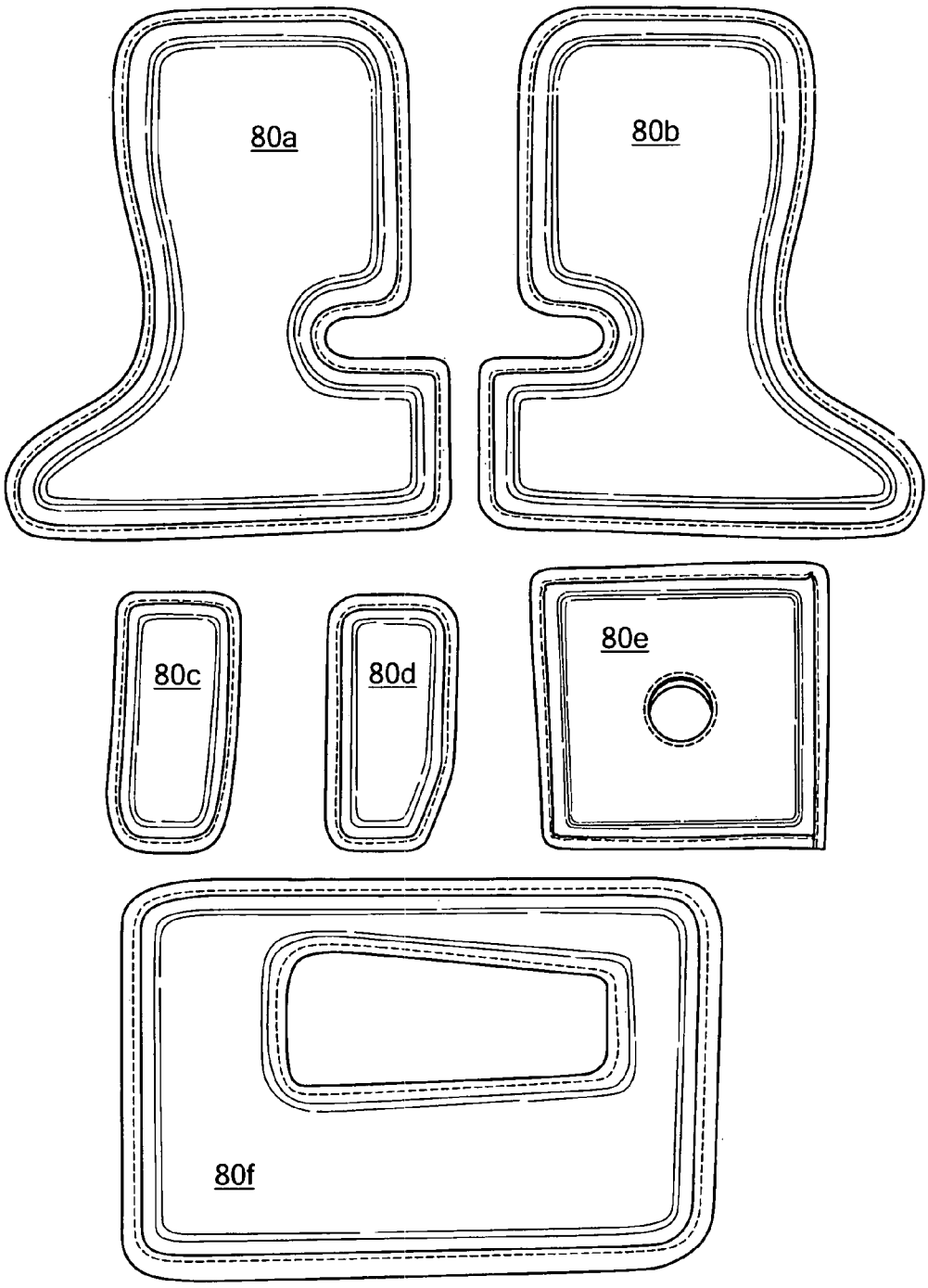
FIG. 7 is a highly schematic three-dimensional top view showing a number of spall liners provided as a kit for a vehicle.

FIG. 7 shows a kit of armor panels 80*a*-80*f* each constructed as discussed above with respect to FIGS. 1-2. The various panels of different configurations can be secured to the inside walls of a vehicle, to the floor, to the seats, to the doors, and the like.

The result, in any embodiment, is a spall liner with numerous plies of Kevlar® or other similar material which is modular, removable and gracefully absorbs the energy of a ballistic threat. The spall liner is easy to install and can be tailored depending on the likely threat to be encountered by varying the number of plies, the type of material used, and the like.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A spall liner comprising:

a first plurality of individual flexible fabric plies of ballistic protective material of a first dimension secured to each other and secured to a first tie layer of a second, larger dimension;

at least a second plurality of individual flexible fabric plies of ballistic protective material of the first dimension secured to each other and secured to a second tie layer of a dimension larger than the first dimension;

the first and second tie layers secured together at outer edges thereof;

a cover; and separable fastener structure of a first type on the cover for removeably securing the liner to the inside hull of a vehicle equipped with separable fastener structure of a second type.

2. The spall liner of claim 1 in which the first plurality of fabric plies are sewn together and to the first tie layer.

3. The spall liner of claim 1 in which the second plurality of fabric plies are sewn together and to the second tie layer.

4. The spall liner of claim 1 in which the cover is sewn to the periphery of the first and second tie layers.

5. The spall liner of claim 1 further including a binder secured over the cover about the periphery of the first and second tie layers.

6. The spall liner of claim 5 in which the binder is sewn over the cover about the periphery of the first and second tie layers.

7. The spall liner of claim 1 in which the plies are made of a ballistic protective fabric material.

8. The spall liner of claim 1 in which the tie layers are made of a ballistic protective fabric or material.

9. The spall liner of claim 1 in which the cover is made of Cordura or other fabric.

10. The spall liner of claim 1 in which the separable fastener structure of the first type includes loop fasteners.

11. The spall liner of claim 1 in which the separable fastener structure of the first type is a layer secured to a side of the cover.

12. The spall liner of claim 11 in which the layer is laminated to the cover.

13. The spall liner of claim 1 in which the cover includes an inward layer including the separable fastener structure of the first type and an outward layer extending over the periphery of the tie layers.

14. The spall liner of claim 1 in which the first tie layer is larger than the second tie layer and the second tie layer is larger than the plies.

15. A spall liner comprising:

a first plurality of flexible fabric plies of a first dimension secured together and secured to a first tie layer of a second, larger dimension;

at least a second plurality of flexible fabric plies secured together and secured to a second tie layer;

the first and second tie layers secured together;

a cover extending over the periphery of each of the first and second tie layers and over the first plurality of flexible fabric plies; and a third plurality of flexible fabric plies and a third tie layer secured thereto and to the first and second tie layers.

16. The spall liner of claim 15 further including:

a separable fastener structure of a first type on the cover for removeably securing the liner to the inside hull of a vehicle equipped with a separable fastener structure of a second type.

17. The spall liner of claim 15 in which the second plurality of plies are of the first dimension.

18. The spall liner of claim 15 in which the first tie layer is larger than the second tie layer and the second tie layer is larger than the first dimension.

19. The spall liner of claim 15 in which the third plurality of flexible fabric plies are of the first dimension, the first tie layer is larger than the second tie layer, the third tie layer is the same size as the second tie layer or smaller than the second tie layer, and all the tie layers are larger than the first dimension.

* * * * *